United States Patent [19]

Popeil

[11] 4,038,892

[45] Aug. 2, 1977

[54] FOOD SLICER WITH INDEXING TURRET

[75] Inventor: Samuel J. Popeil, Chicago, Ill.

[73] Assignee: Popeil Brothers, Inc., Chicago, Ill.

[21] Appl. No.: 702,470

[22] Filed: July 6, 1976

Related U.S. Application Data

[63] Continuation-in-part of Ser. No. 595,148, July 11, 1975, abandoned.

[51] Int. Cl.[2] ..... B26D 4/42; B26D 4/70

[52] U.S. Cl. ..... 83/4; 83/425.3; 83/431; 83/437; 83/717; 83/858

[58] Field of Search ..... 83/4, 9, 11, 407, 404, 83/404.4, 425.1, 425.2, 425.3, 425.4, 431, 437, 710, 711, 856, 858, 717

[56] References Cited

U.S. PATENT DOCUMENTS

| | | | |
|---|---|---|---|
| 265,799 | 10/1882 | Hall | 83/404 X |
| 377,909 | 2/1888 | Ponath | 83/717 |
| 911,478 | 2/1909 | Dorsey | 83/407 X |
| 1,479,469 | 1/1924 | Kirnbauer | 83/717 X |
| 1,974,194 | 9/1934 | Phillips | 83/431 X |
| 2,533,843 | 12/1950 | Sipe | 83/404.3 |
| 2,583,595 | 1/1952 | Rodel et al. | 83/431 |

*Primary Examiner*—Willie G. Abercrombie
*Attorney, Agent, or Firm*—Dominik, Knechtel, Godula & Demeur

[57] ABSTRACT

A food slicer with an indexing turret is disclosed in which the turret has four faces, two of which have upstanding blades of different sizes on opposed faces, and two of the faces have a different offset relationship to the center line of the turret. An angled blade is provided in a table blade segment opposed to the angled turret. A table lock segment slidingly fits into the body of the slicer, and its angled front edge portion locks the indexing turret into position for the varying slices to be made. A pusher which is held by the hand is held on top of the foodstuffs to be cut, and optionally has a guide underportion which, when approaching the last slice, engages the body side guide rails in order to minimize the amount of uncut foodstuff. The table blade segment may be positioned by means of a table blade latch into two parallel ways, one above the other, thereby providing for two different thicknesses of slices due to the position of the blade which is angled at one end of the table blade segment. By combining this with the two flats on the indexing turret, four different thicknesses of slice may be made. By rotating the indexing turret to the two positions where french fry blades and shoe string blades are located, french fries and shoe strings of square cross section or half a square cross section may also be cut. The base of the unit at one portion is provided with a plate recess so that the sliced foodstuffs may be dropped on a plate, and the opposite end of the base is provided with a counter stop which permits securing the unit against the edge of a counter or table to secure it against the reactive forces occasioned by passing the foodstuffs through the blade. In one embodiment the turret indexes automatically by means of a turret cam head arrangement actuating the table lock segment against the yieldable action of a spring.

30 Claims, 15 Drawing Figures

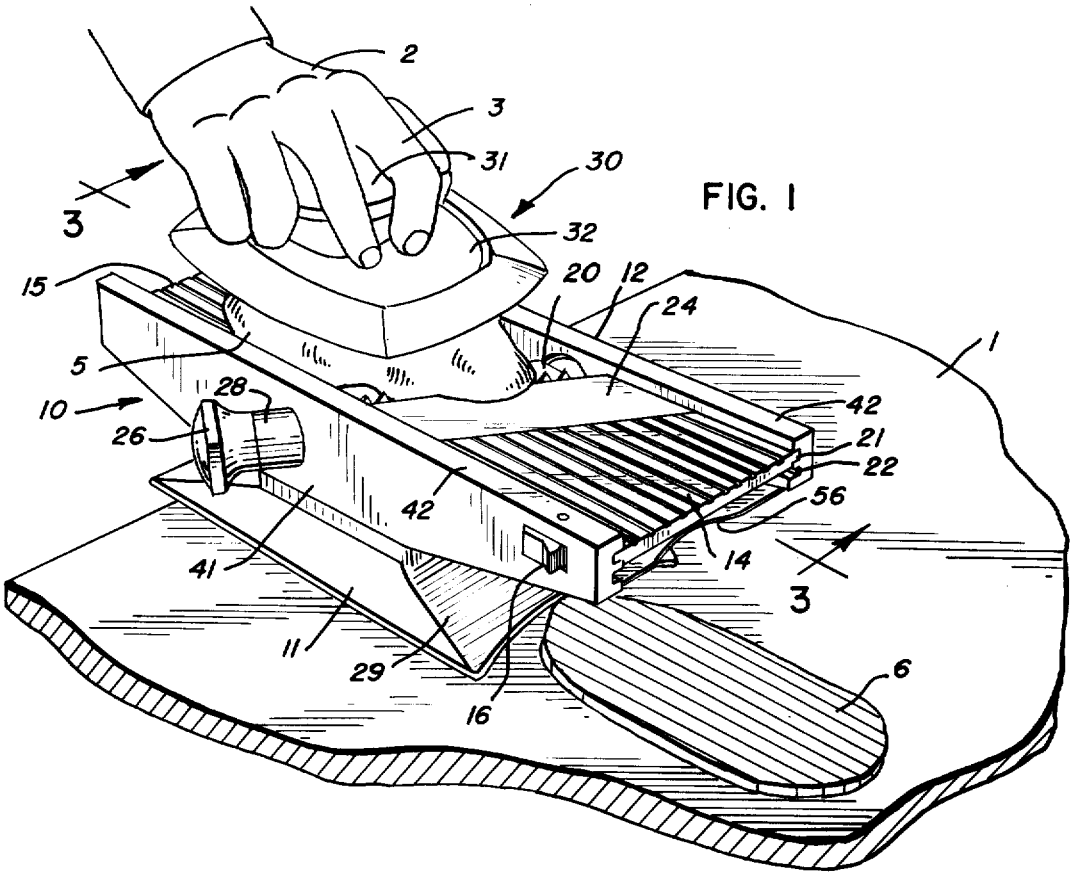
FIG. 1
FIG. 2
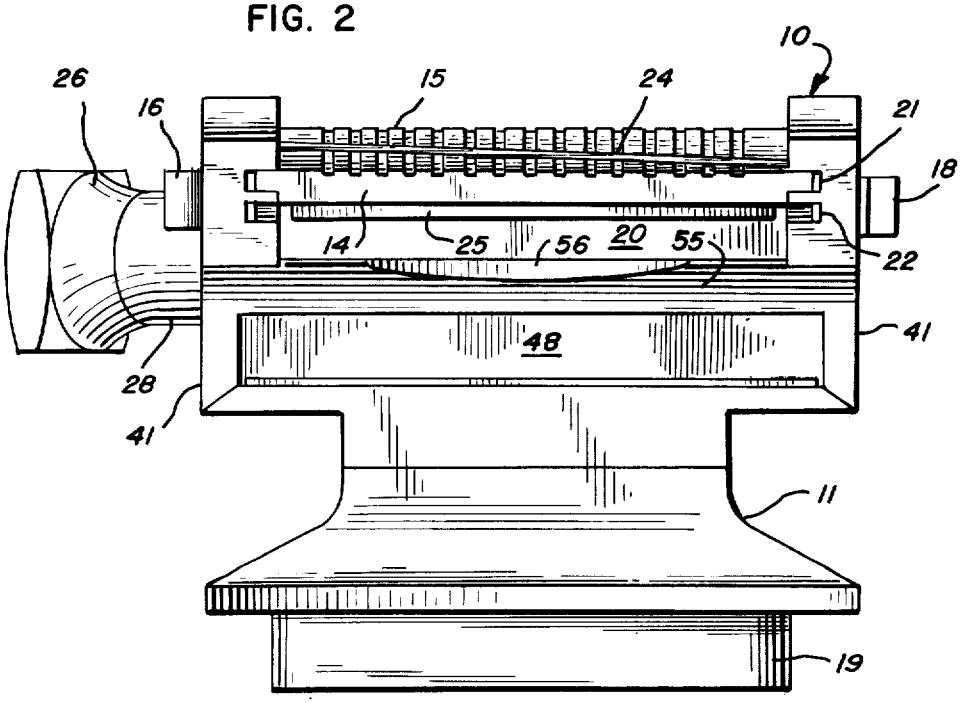

FIG. 12
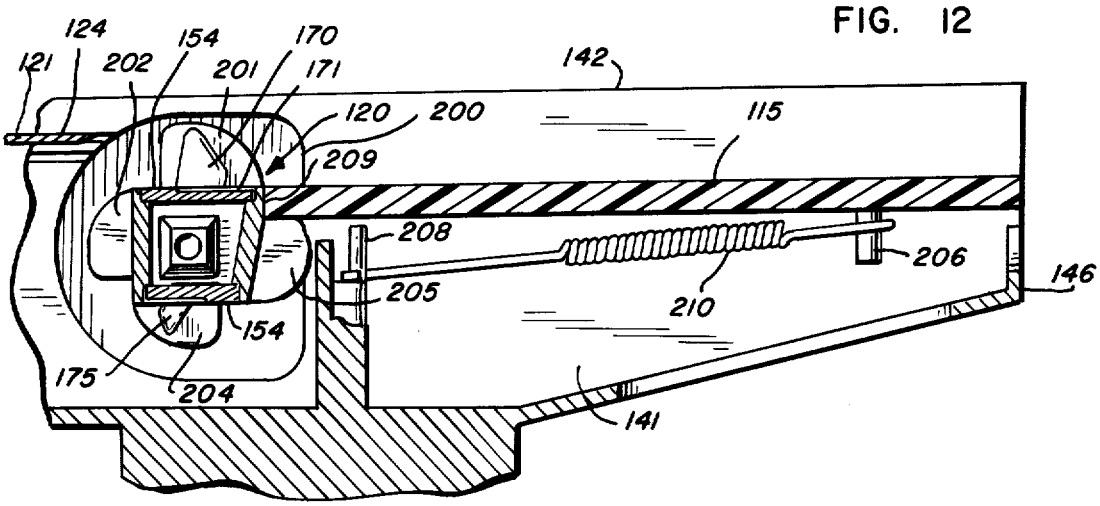
FIG. 13
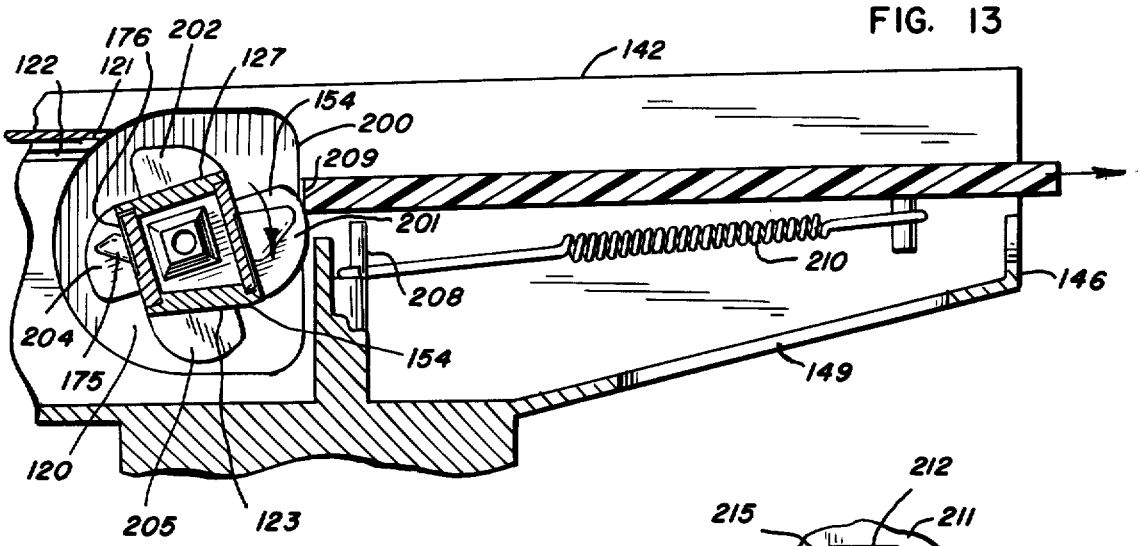
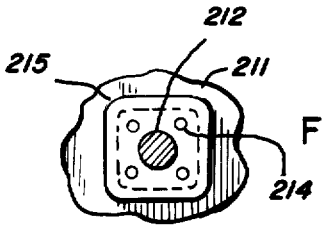
FIG. 14
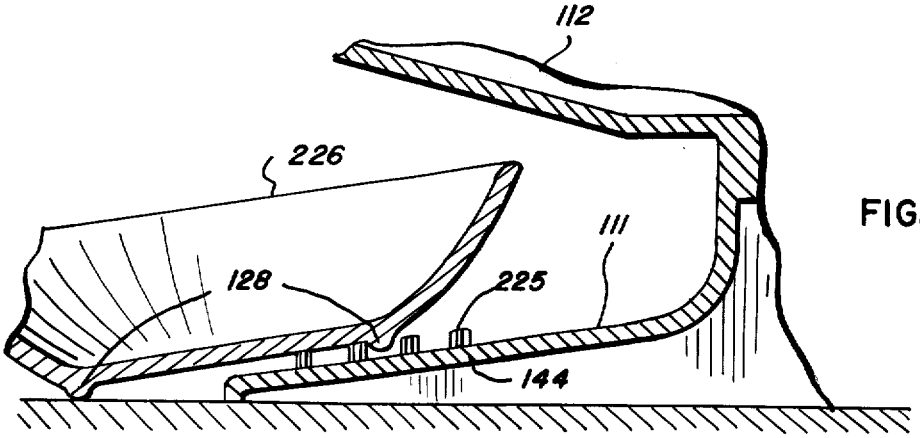
FIG. 15

FOOD SLICER WITH INDEXING TURRET

RELATED APPLICATIONS

This application is a continuation-in-part of earlier filed application Ser. No. 595,148 filed July 11, 1975, now abandoned.

FIELD OF INVENTION

The subject invention relates generally to food slicers, and more particularly those which are manually operated, and provided with means for cutting other than flat slices. Examples of the general field are found in Patent Office Class 146.

SUMMARY OF THE PRIOR ART

The prior art is exemplified by many devices, not the least of which is applicant's food cutter construction shown in U.S. Pat. No. 2,991,814, and the prior patents cited in connection with the prosecution of that patent. In addition, certain foreign patents such as Japanese Pat. No. 778,001 relate to a Benrinner cutter marketed under the trademark "Cuttix". A German device marketed under the trademark "Universalhobel", the company name being indicated as Eimde GSD, all are examplary of the prior art.

The devices known, and exemplified in the patents just cited, invariably have several auxiliary parts which must be interchanged with the operative construction in order to make french fries, julienne, or shoe string cuts, thick slices, or thin slices. Furthermore, many of the prior art devices can accomodate only small vegetables, and not the typical long potato or cucumber as many homemakers wish to slice or otherwise cut for cooking.

In addition, many of the constructions in the prior art either give rise to a risk of cutting the fingers, or alternatively, cannot accommodate a large portion of the piece of foodstuff to be cut, and hence there is waste insofar as the particular end product may be concerned.

Finally, because the means for holding the foodstuff will not accommodate long or large pieces, when thin pieces are being sliced, the uniformity of thickness throughout the length may vary and cause undesirable curling, or lack of uniformity in cooking.

SUMMARY

The present invention stems from the provision of an indexing turret having a plurality of faces, at least two of which are flat surfaces at varying positions with regard to the axis, and at least two of which have vertically mounted cutting blades positioned along a plane essentially perpendicular to the plane of a horizontal cutting blade. The horizontal cutting blade, in turn, is secured to a table blade segment which may be positioned at two levels, to coordinate with the offset levels of the indexing turret. In order to insure dimensional stability, the indexing turret is locked in place by means of the table lock segment which is a continuation of the opposed surface of the indexing turret. Means are provided at one end of the indexing turret for a knob to rotate the same and secure it at any of four positions on a ninety degree spacing. At the opposite end of the indexing turret, means is provided for pivotally mounting the same. In the first embodiment both the table blade segment and table lock segment are provided with latches for removing the same in order to either rotate the indexing turret, or change the level of the blade. In the second embodiment the table lock segment is yieldably urged against the indexing turret. Upon rotation of the index turret knob, a cam head with a plurality of cams engages the front end of the table lock segment, and while rotating the turret head, the table lock segment is retracted and relocks when the new portion of the turret head is presented. The table blade segment and table lock segment are provided with grooved surfaces or ribs to reduce friction in passing the foodstuffs to the blade.

In view of the foregoing, it is a principal object of the present invention to provide a food slicer with an indexing turret in which a multiple of functions are accomplished, and no independent attachments or independent components are required to be interchanged in order to accomplish the functions.

Another object of the present invention is to provide a food slicer with an indexing turret which will slice four different thicknesses of flat slices, by utilizing two offset faces on the indexing turret, and two positions of the table blade segment and its associated blade. Yet another object of the invention is to provide such a food slicer in which, by means of a turret head cam, the turret can be automatically indexed and relocked for usage.

A further object of the invention is to provide a food slicer with an indexing turret in which two segments of the turret provide a plurality of vertical blades on uniform spacing, one set of which will cut sizes comparable to french fries, and the other comparable to julienne or shoe string sizes.

Still another object of the present invention is to provide a food slicer with an indexing turret with a coordinated pusher which safeties and holds the foodstuff with short depending fingers which will not hit the blades. This not only protects the user's hand or fingers from cutting by the blade, but also insures that a minimum amount of foodstuff remains uncut after reciprocating the foodstuffs and engaging them with the blade.

A related object of the present invention is to provide a pusher with a longitudinal pattern of pins which achieve better and uniform penetration of the foodstuff, and thereby hold long items such as potatoes or cucumbers or carrots so that lengthy slices may be made. With this construction, carrot curls, and cucumber and potato slices are uniformly and swiftly prepared.

Another object of the present invention is to provide a food slicer which will cut at relatively rapid manual speeds and insure dimensional stability and uniformity of slice or cut, and yet be susceptible of economical manufacture.

DESCRIPTION OF DRAWINGS

Further objects and advantages of the present invention will become apparent as the following description of two illustrative embodiments takes places, taken in conjunction with the accompanying drawings in which:

FIG. 1 is a perspective view of the subject slicer showing how a potato may be sliced, illustrating the same atop a portion of a table or counter.

FIG. 2 is a front elevation taken from the right hand portion of FIG. 1 showing the subject slicer, and illustrating the counter stop at the lower portion of the unit.

FIG. 12 is an enlarged broken partially transverse sectional view taken along section line 12—12 of FIG. 11.

FIG. 13 is a view taken from the same section and scale as FIG. 12, but showing the action of the turret head and the cam while rotating.

FIG. 14 is an enlarged broken view taken along section line 14—14 of FIG. 11.

FIG. 15 is a partially broken tranverse section enlarged view of the base illustrating how a bowl may be positioned there beneath to receive foodstuffs as they are processed.

DESCRIPTION OF FIRST EMBODIMENT

Figure 3:
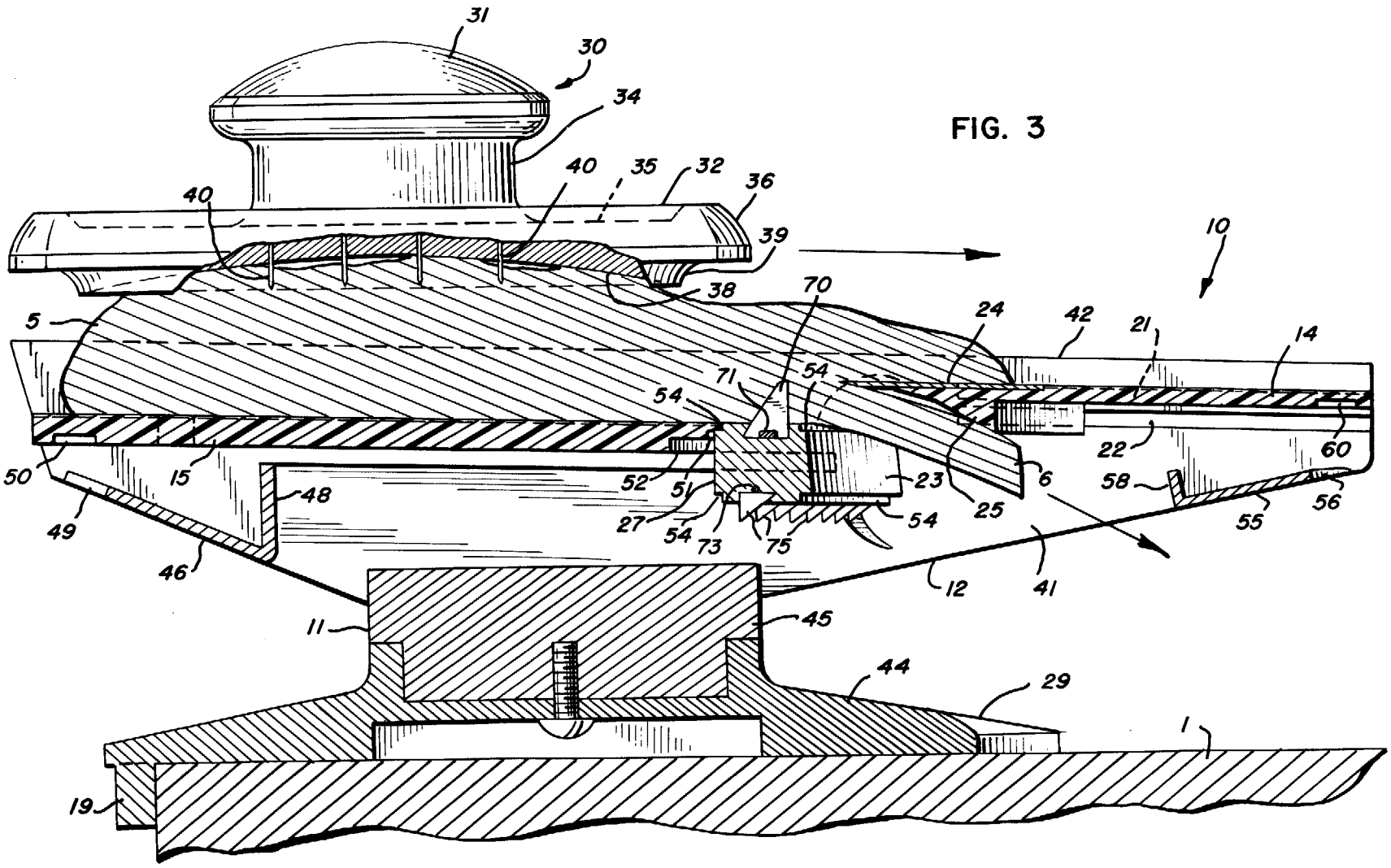
FIG. 3 is an enlarged transverse sectional view taken generally along section line 3—3 of FIG. 1.

The first embodiment food slicer with indexing turret 10, hereinafter referred to generally as "slicer 10", is illustrated in operative configuration in FIG. 1. There it will be seen that the slicer 10 is positioned on top of a kitchen counter 1 and is being employed by means of the hand 2 of the operator, grasping the pusher 30 by means of the operator's fingers 3, to reciprocatingly advance and retract the potato 5 against the blade 24 of the slicer 10. The result, as shown, is a potato slice 6 atop the kitchen counter 1. As will be described hereinafter, four different thicknesses of potato slices 6 can be developed by positioning the blade 24 in varying relationships with the indexing turret 20. Naturally, in addition to cutting potatoes such as shown, cucumbers, carrots, cheese, radishes, and many other food products normally sliced can be advantageously and efficiently sliced with the subject food slicer with indexing turret 10.

The basic structure of the food slicer 10 contemplates a base 11, and a body portion 12. There are two sides 41 to the body 12, terminating at their upper portion in body side guide rails 42. The blade 24 is at the end portion of the table blade segment 14, and is angled at substantially a 45° angle to the body sides 41 and their respective body side guide rails 42. Opposed to the table blade segment 14 and the blade 24 is a table lock segment 15 which, as will be described hereinafter, is the support for the foodstuff such as the potato 5, and in addition at its forward edge portion provides means for locking the indexing turret 20. The table blade segment 14 may be positioned in table blade upper way 21 or table blade lower way 22 to the end that the cutting edge of the blade 24 is in two levels with regard to the indexing turret 20 and the table lock segment 15. The table blade segment 14 is releasably secured by means of the table blade latch 16. As shown in FIG. 2, a table lock latch 18 is similarly provided for releasably securing the table lock segment 15 for removal in order to index the indexing turret 20 by means of the index turret knob 26. A turret lock base 28 extends from one of the sides 41 of the food slicer, and journals for specific indexing the index turret knob 26 as shown generally in FIGS. 1 and 2, and as will be described in greater detail with regard to FIG. 4.

The details of the internal portions of the slicer 10, as well as a better understanding of its operation, are shown partially diagrammatically in FIG. 3. There it will be seen that the pusher 30 and its associated pusher grip 31 are positioned atop the potato 5 and engage the same by means of the pins 40. The pusher body 32 extends a distance to overlap the body side guide rails 42 when the potato 5 has been cut to its minimum thickness. At this point, the guide 39 on the underneath portion on the rim 36 of the pusher 30 will nestingly engage the body side guide rails 42. To be observed in greater detail in FIG. 3 is the finger shield 35 interiorly of the rim 36, as well as the finger grip portion 34 beneath the pusher grip 31. The underneath portion 38 of the pusher 30 is concave, to receive the rounded configuration of most foodstuffs. An alternative embodiment is shown in FIGS. 7 through 10 in which the underneath portion of the pusher 30 (alternative embodiment) is flat.

The structural integrity of the slicer 10 relates to its base support and table as well as cross bracing assembly, and as will be noted in FIG. 3, shows the base 11 and its component parts. The base 11 includes the base foot 44 with an underneath flat portion which is positioned atop the counter or kitchen table 1, with the counter stop 19 engaging the edge of the counter 1. A base foot mount 45 extends downwardly from the body 12 of the slicer 10, and is secured to the base foot 44. It will be appreciated that under certain molding conditions, a single piece unitary body may be formed, albeit at a significant increase in mold cost. The invention as shown and described and claimed is independent of the specific base, or unitary construction of certain molds. The body sides 41 are joined at the rear portion by the rear cross tie 46 which has an upstanding brace 48 thereby defining a generally L-shaped cross section of the rear cross tie 46. A finger recess 49 is provided at the rear portion of the rear cross tie 46 so that the fingers may be positioned into the finger grip 50 of the table lock segment 15 for slidably removing the same from its locking engagement with the indexing turret 20. To this end, a turret lock undercut 51 is provided at the forward portion of the table lock segment 15, with a turret blade undercut 52 therebeneath and rearwardly thereof. The turret blade undercut 52 is provided to accommodate the french fry blades 70 or the shoe string blades 75, when they are in the out-of-use configuration when rotated 90° from that configuration shown in FIG. 3. More specifically, the turret lock undercut 51 defines an extension which engages the turret lock notch 54 on the indexing turret 20.

At the forward portion of the slicer 10, again as shown in FIG. 3, a deflector brace 55 joins the two body sides 41 of the slicer 10. At the rearward portion of the deflector brace 55, a deflector segment 58 is provided in a generally L-shaped relationship to the deflector brace 55. It cooperatively relates to the finger grip cut-out 60 of the table blade segment 14 whereby the user may insert the fingers into the finger grip 60 for removably positioning the table blade segment 14 in the two table blade ways 21, 22. Also to be noted is that the under side of the table lock segment 15, rearwardly from the blade 24, is provided with a blade support deflector 25 which, as shown in FIG. 3, deflects the slice 6 downwardly toward the plate recess 29, so that the slice 6 can be stacked up on top of a plate positioned in that location.

Figure 4:
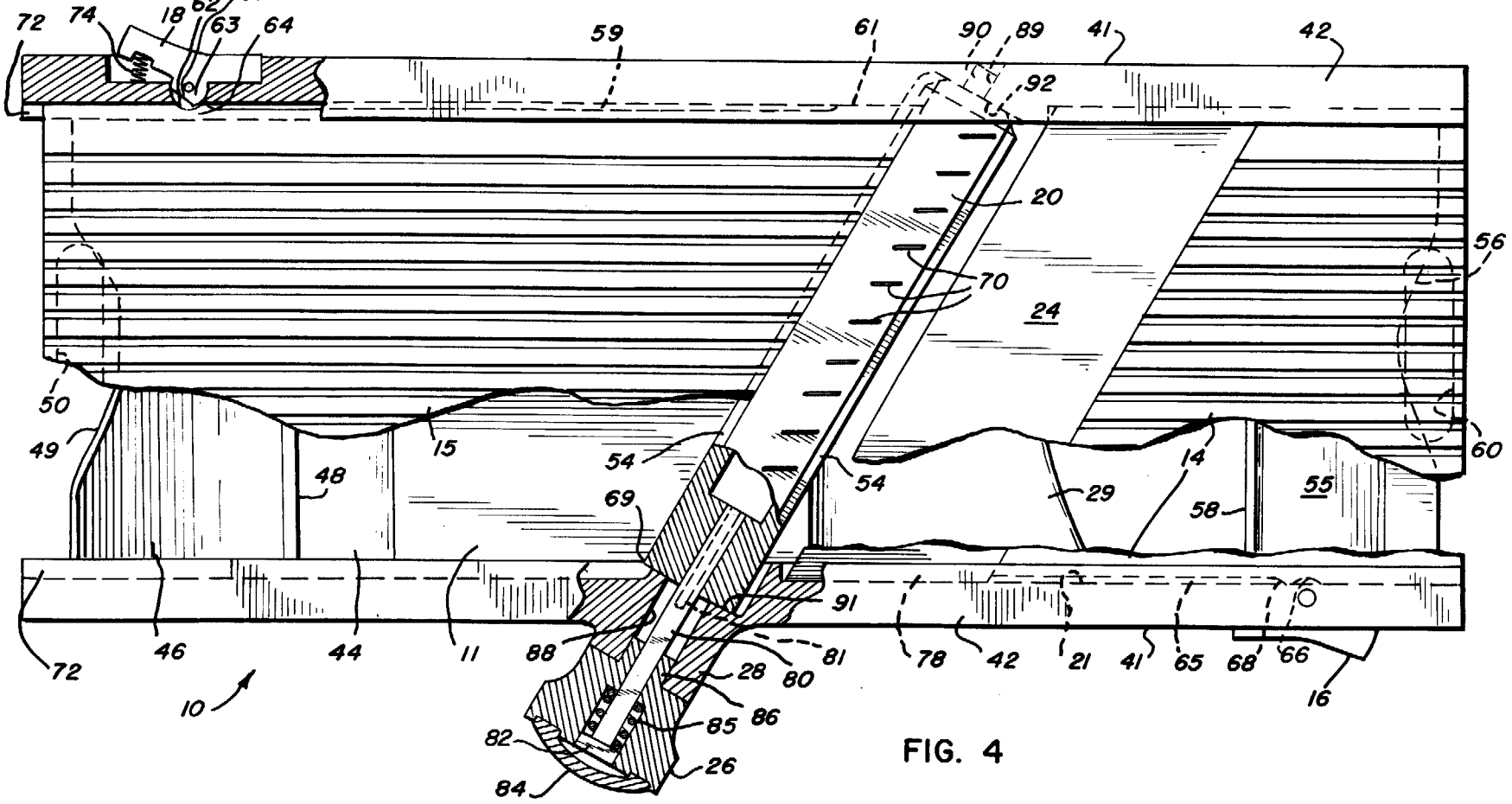
FIG. 4 is a top plan view partially broken and partially sectioned illustrating the indexing mechanism for the indexing turret.

The table lock latch 18 as well as the table blade latch 16 are illustrated in their cooperative relationships between their respective table blade segment 14 and table lock segment 15 in FIG. 4. There it will be seen that, for example, to release the table lock segment 15 for indexing the indexing turret 20, the user need only depress the extending portion of the table lock latch 18, thereby releasing the projection 63 from the lock detent 62. The user then slips his finger into the finger grip 50 beneath the table lock segment 15, and removes the same. Because of the provision of a lock offset 61 at the remote end of the table lock segment 15, defined by the latch offset recess 59, as the user immediately releases the table lock latch 18, the projection 63 rides in the latch offset recess 59, and at that point where the lock offset 61 is about to engage the projection 63, the remote corner 69 of the table lock segment 15 will have already cleared the rear portion of the body side guide rail 42 opposite the table lock latch 18 and the table lock segment is removed. Operating in the other direction, however, the table lock segment 15 is inserted into the table lock segment guides 72. The forward portion of the lock offset 61 engages the flat 67 of the projection 63, thereby deflecting pivotally the table lock latch 18, and permitting the insertion of the table lock segment 15 to where the latch resumes its normal position urged by means of spring 74 and rides within the latch offset recess 59 until engaged by the lock actuator 64, whereupon the latch again works against the spring 74 and then drops into locking relationship with the lock detent 62.

Substantially the same type of mechanism is being employed with the table blade latch 16, as will be shown in the diagonally opposed position in FIG. 4. There it will be seen that the lock offset 65 is provided on the longer edge portion of the table blade segment 14, terminating with the corresponding lock offset 78 which is, again, determined by the thickness of the blade 24. Also, a lock offset 65 and lock detent 66 coact with a flat, and spring (not shown) of substantially the identical configuration of that shown in connection with the table lock latch 18. Similarly, when the table blade segment 14 is withdrawn by means of releasing the latch 16, and pulling the same with the finger grip 60, the member disengages itself from the ways 21, 22, and is thereby readily removed. Alternatively, upon reinsertion in either the table blade upper way 21 or table blade lower way 22, the table blade latch 16 is actuated in the same fashion as described in detail with regard to the table lock latch 18.

Turning now to FIG. 3, it will be seen that on one portion of the indexing turret 20 large french fry blades 70 are provided, the same being connected by blade links 71 to position the same for molding when the indexing turret 20 is formed. Similarly, on the opposite side of the indexing turret 20, a plurality of parallel shoe string blades 75 are provided which are joined by means of blade links 76. Again, the invention is independent of the particular means of forming the blades 70, 75 or molding the same. An alternative construction of providing U-shaped pairs of blades 70, 75 is also contemplated. What is important, however, is that the blades 70, 75 be positioned parallel with the longitudinal axis of the table lock segment and table blade segments 15, 14.

The indexing member is more specifically shown in FIG. 4, where it will be seen that where the knob 26 is provided for coacting engagement with a turret lock base 28. An indexing shaft 80 is provided with a D-shaped cross section 81 at its remote end which is inserted into the indexing turret 20 to lock the same against rotation. At its opposite end, the indexing shaft 80 is provided with a square head 82. Optionally, an end cap 84 may be provided to cover the knob 26 and its associated indexing shaft 80 to preclude foodstuffs from entering therein. A spring 85 abuts the square head 82 of the indexing shaft 80. In operation, the knob 26 is removed from its position in close relationship with the turret lock base 28, and then, after the table lock segment 15 has been moved out of locking relationship with the indexing turret 20, the knob 26 is rotated. The lower portion of the knob 26 has a male square 86 which engages a female square 88 in the turret lock base 28. The remote end of the indexing turret 20 is a stub shaft 90 mounted in a stub shaft recess 89 in one of the body sides 41. Thus, upon indexing, the knob 26 and its square end 86 is positioned optionally at 90° rotations of the indexing turret 20, the same being secured for rotation at both ends by angled bases 91, 92, in the opposed sides.

Figure 8:
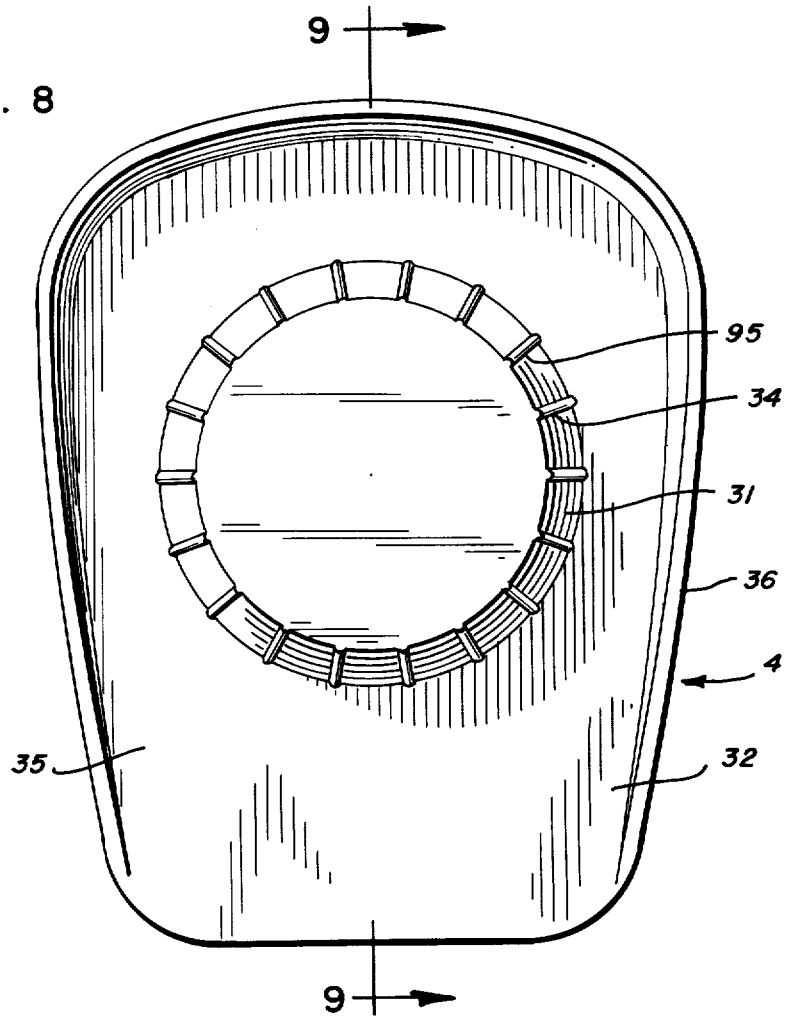
FIG. 8 is a top view of an alternative embodiment pusher.
Figure 9:
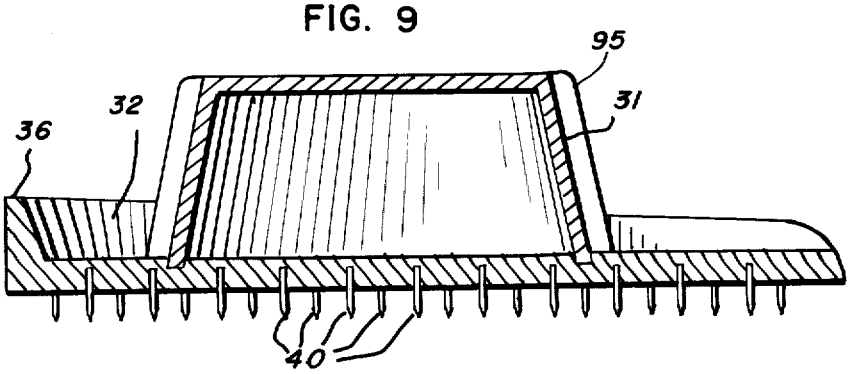
FIG. 9 is a longitudinal sectional view of the pusher embodiment shown in FIG. 8 taken along section line 9—9.
Figure 10:
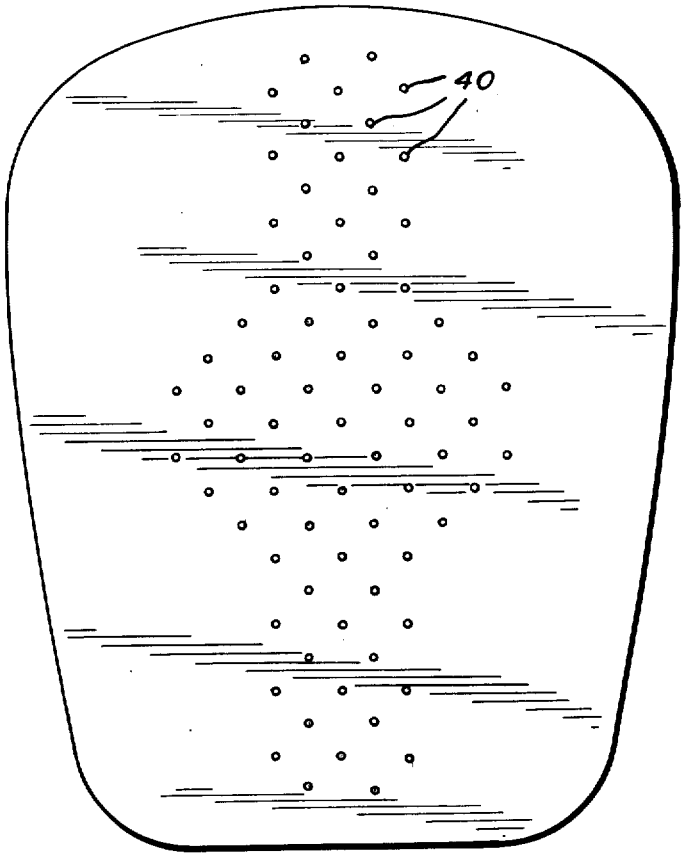
FIG. 10 is a bottom view of the alternative embodiment pusher shown in FIGS. 8 and 9 illustrating the pin pattern which engages the foodstuffs.

The alternative embodiment pusher 94 is shown in FIGS. 8, 9 and 10. There it will be seen, by using common reference numbers, that the pusher grip 31, and pusher body 32 may be assembled as two separate elements. The finger grip 34 is a function of a plurality of ribs 95, and the finger shield 35 is the upper portion of the body 32. A rim 36 surrounds the entire unit and protects the fingers in usage. The pins 40, particularly as shown in FIG. 10, have a different pattern, the same being longitudinal from almost one end to the other of the alternative embodiment pusher 94, with a substantially diamond shaped pattern at a mid portion, to thereby accommodate a wider variety of foodstuffs. The underside 38 is flat, and may be optionally provided with a guide 39 as referenced with regard to the first embodiment 30. With the alternative embodiment pusher 94, however, the primary differences relate to a flat underbody portion, and a long pattern of the pins 40.

OPERATION AND USE

Figure 5:
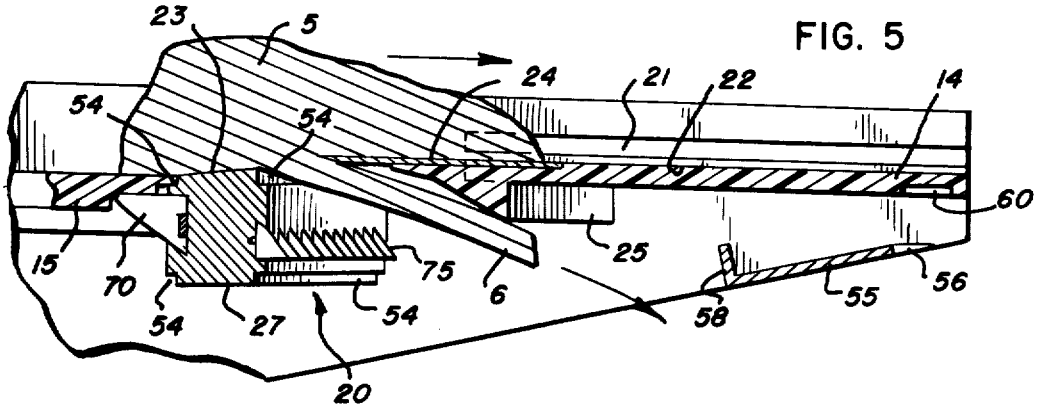
FIG. 5 is an enlarged longitudinal sectional view taken at a central portion of FIG. 3, illustrating how varying thicknesses of slices may be formed by rotating the indexing turret and/or adjusting the blade.
Figure 6:
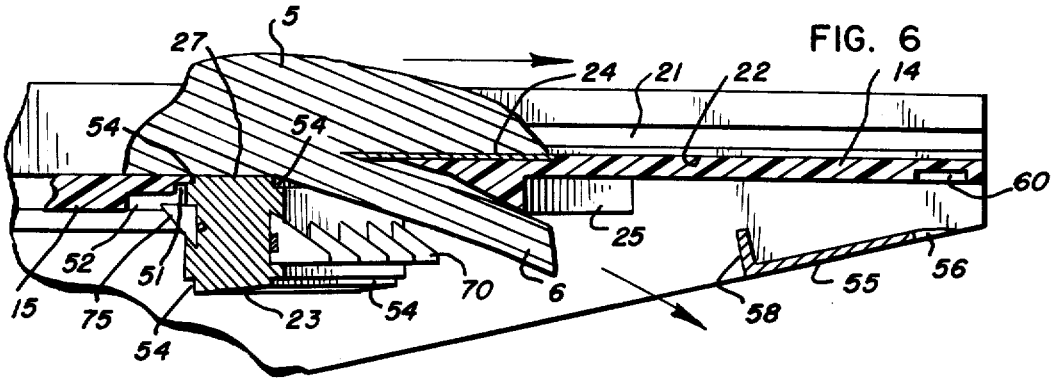
FIG. 6 is a view corresponding to that of FIG. 5 illustrating a thicker slice.
Figure 7:
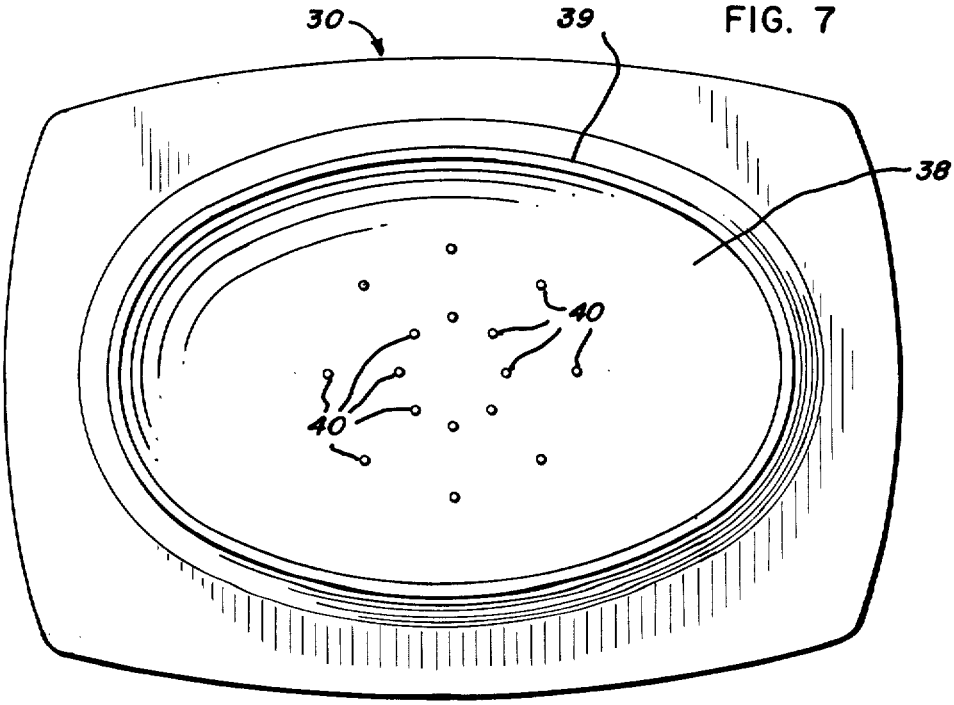
FIG. 7 is a bottom view of one embodiment of the pusher, that shown particularly in FIGS. 1 and 3.

The actual use of the slicer 10 is well illustrated in FIG. 1, as supplemented by FIGS. 3, 5 and 6. When seeking to change the position of the turret 20, it is best to position the slicer 10 vertically, such as shown in FIG. 4, assuming that the same is positioned vertically with the table blade segment 14 down. The user then depresses the table lock latch 18, grasps the finger grip 50 of the table lock segment 15, and removes the same. Thereafter, by withdrawing the index turret knob 26, the same may rotate 90°, 180°, or 270° to select the additional face of the turret 20 for cutting, whether it be directed to varying thicknesses of slice, or the shoe string or french fry cuts produced by the respective blades 70, 75. Thereafter, the table blade segment 14 is reinserted. Then, if a varying thickness of slice is desired, the slicer 10 is inverted, with the table blade segment 14 upwardly. The table blade segment 14 is removed by depressing the table blade latch 16, and grasping the same with the finger grip 60, in the same fashion as the table blade segment 14 is removed. The same may then be repositioned in either of the upper way or lower way table blade guides 21, 22 for the varying slices.

As shown particularly in FIG. 5, there is an angled face 23 on the indexing turret 20, as well as a flat face 27 on the indexing turret 20. The angled face 23, in a commercial embodiment, is provided with an angle of approximately 8°. This permits a varying in the thickness between the two opposed faces 23, 27 of approximately 0.055 inches. Therefore, upon rotating, the turret lock notch 54 engages the turret lock undercut 51 of the table lock segment 15 in the same position, just as shown in FIGS. 5 and 6 by way of comparison. It will be noted that the slice 6 in FIG. 5 is thinner than the slice 6 in FIG. 6. Also to be noted is how the upstanding french fry and shoe string blades 70, 75 are accommodated by means of the turret blade undercut 52.

Again, in a commercial embodiment, a spacing of approximately 0.187 inches between the upper and lower ways 21, 22 results in thicknesses having the following dimensions:

1. Thinnest slice — 0.055 inch
2. Thicker slice based upon turret rotation — 0.110 inch
3. Thinnest slice with table blade segment repositioned — 0.242 inch
4. Thickest slice with table blade segment repositioned and turret rotation — 0.297 inch In addition, the spacing of the french fry blades 70 on 0.297 inch center and the shoe string blades 75 on 0.110 center is such that when the table blade segment 14 is repositioned from the upper way 21 for french fries to the lower way 22 for shoe strings, that square cuts will result.

DESCRIPTION OF SECOND EMBODIMENT

Figure 11:
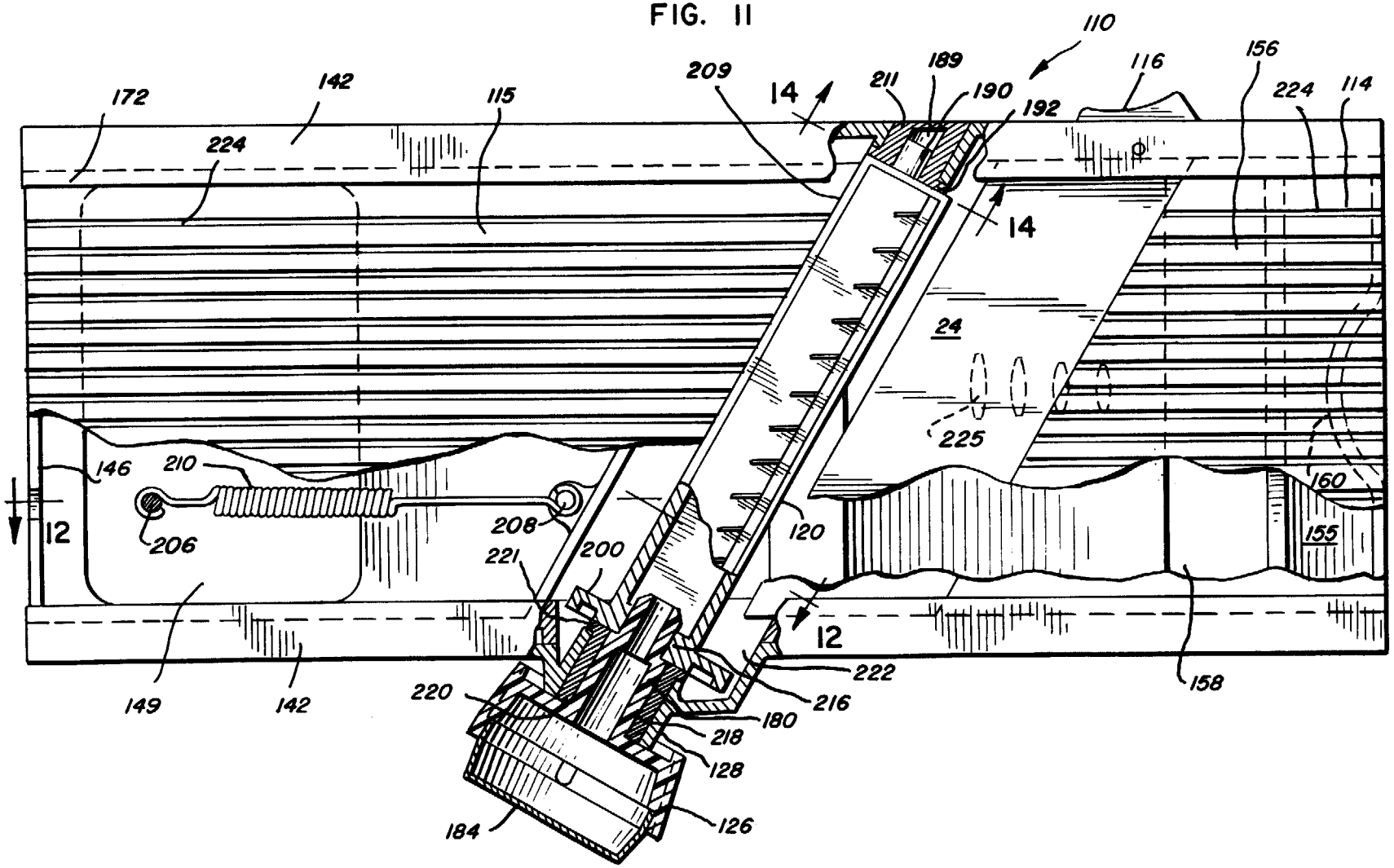
FIG. 11 is a plan view, partially broken and partially sectioned, of the second embodiment of a food slicer with an indexing turret.

The second embodiment food slicer 110 differs from the first embodiment by providing for an automatic indexing of the turret. Where common reference numerals are applied to the second embodiment description, already described in the first embodiment, they will be the same reference numeral except in the 100 series. Referring now to FIGS. 11 and 12, it will be seen that the second embodiment (hereinafter food slicer 110) includes a base 111, a body 112, and a table blade segment 114 as well as a table lock segment 115, the table blade segment being secured for repositioning by means of a table blade segment latch 116.

The indexing turret 120 is comparable in position and location to the indexing turret 20 of the first embodiment slicer 10. Likewise, the table blade upper way 121 and the table blade lower way 122 (see FIGS. 12 and 13) provide for two positions of the table blade segment 114 and more particularly its cutting blade portion 124. The indexing turret 120 is rotated by means of the index turret knob 126. The turret lock base 128 assists in securing the index turret knob 126 as will be described in detail hereinafter.

As noted in FIGS. 12 and 13, the body sides 141 terminate at the upper portion with a body side guide rail 142. A pusher 30 (130) of the embodiments shown in connection with the first embodiment food slicer 10 may be employed to push foodstuffs in the same fashion as with the first embodiment slicer 10. The base foot 144, however, is modified by the provision (see FIG. 15) of a plurality of bowl stops 225 which, as will be noted in connection with bowl 226, engage the bowl base ring 228 and prevent the same from slipping when it is put in position beneath the cutting blade to catch foodstuffs.

The body sides 141 are joined by a rear cross tie 146 as well as the connection provided by the base 111. Also to be noted is a finger recess 149 to assist in holding the unit, even though in the second embodiment 110 provision is made for a counterstop 119 as in the first embodiment. The turret lock notches 154 (see FIGS. 12 and 13) are engaged by the butt end 209 of the table lock segment 115. The deflector base 155 is provided with an adjacent finger cut out 156, and also coordinated with a deflector segment 158 to perform in substantially the same fashion as with the first embodiment 10. Finally, note should be taken in FIG. 11 of the finger grip 160 on the table blade segment 114 to be used when the table blade segment 114 is removed for positioning in one or the other of the table blade ways, 121, 122.

As shown in FIGS. 11, 12 and 13, provision is made for french fry blade 170, secured by means of a french fry blade link 171. The shoe string blades 175 are similarly joined by shoe string blade links 176. As noted particularly in FIGS. 12 and 13, the french fry blades 170 are positioned on the indexing turret 120 at a position opposite the shoe string blades 175.

Finally it will be noted that additional common elements between the second embodiment 110 and the first embodiment 10 food slicer include the guides 172 for the table lock segment 115, as well as certain details of the turret head 120. For example, it will be noted in FIG. 11 that an indexing shaft 180 is at one portion of the indexing knob 126, and an end cap 184 at the other portion. The opposite end of the turret 120 includes a stub shaft 190. The turret 120 rotates against an angled base 192, the details of which will be described hereinafter.

As the following description proceeds, it will be noted that a 200 series of reference characters is applied, denoting elements in the second embodiment food slicer 110 which differ from the first embodiment 10. To be observed particularly in FIGS. 12 and 13, is the cam head 200 which is provided with a french fry cam 201, a flat surface cam 202, a shoe string cam 204, and an angled surface cam 206. Each of these cams are positioned at one end of the turret 120 adjacent the turret knob 126. The cam head 200 is, as noted, adjacent the knob 126 preferably, but may be positioned at the opposite end of the turret 120 adjacent the stub shaft 190. As noted in FIGS. 12 and 13 particularly, provision is made for a base spring post 208 as well as a table spring post 206. The coil spring 210 is connected at its respective ends to the post 206, 208. The spring 210 then coacts with the table lock segment 115 in order to yieldably urge its butt end 209 against the respective cams on the cam head 200 as well as notches 154.

As seen in FIG. 11, as well as FIG. 14, the stub shaft 190 of the turret rotates in the turret bearing 211 having a journal 212 to receive the stub shaft 190. The pins 214 serve to secure the turret bearing 211 to the body 112, and provide a square head 215 to about the end of the turret 120. The pins 214 serve to lock the same in position, thereby presenting the recess 189 for the stub shaft 190. Further details of the index turret knob 126 appear in FIG. 11 where it will be seen that a square stub shaft 216 extends from its far end, and is received in a square recess in the cam head assembly 200. Between the index turret knob 126 and the square stub shaft 216 is a round shaft 218 which is journaled in the bearing 220. The bearing collar 221 abuts the cam head assembly 200, and secures the same as well within the turret lock base 128. To be noted also are the ribs 224 provided on the surface of the table blade segment 114 and the table lock segment 115 to prevent wet slices of foodstuffs from sticking to the table, and also to facilitate cleaning.

OPERATION AND USE

In the second embodiment food slicer 110, the operation is substantially identical of that of the first embodiment 10, with the exception of indexing the turret 120. With the second embodiment 110, the knob 126 is grasped, and rotated in a counterclockwise direction. This causes the cam head 200 to selectively engage the butt end 209 of the table lock segment 115, and remove the same from its locked relationship with the lock notches 154 of the turret 120. After the particular cam has passed the butt edge 209 (shortly after the position shown in FIG. 13) the coil spring 210 returns the table lock segment 115 into its locked relationship with the turret 120, while nested in the particular notch 154, as noted in four positions on FIG. 12. There will be seen that both a flat face 127 and angled face 123 are provided on the second embodiment turret 120, and accordingly the comparable thickness of slices, as well as the julienne and french fry slices and shoe strings can be achieved, but without a requirement for manually unlocking and repositioning the table lock segment 115. The two positions of the table blade segment 114, are achieved in substantially the same fashion as with the first embodiment 10, and the table blade segment latch 116 functions in substantially the same fashion as the table blade latch 16 in the first embodiment food slicer 10.

Although particular embodiments of the invention have been shown and described in full here, there is no intention to thereby limit the invention to the details of such embodiments. On the contrary, the intention is to cover all modifications, alternatives, embodiments, usages and equivalents of a food slicer with indexing turret as fall within the spirit and scope of the invention, specification and the appended claims.

What is claimed is:

1. A food slicer with indexing turret comprising, in combination, a body having a base portion and opposed sides, a blade angled across the body portion and between the sides thereof, a table blade segment insertable into the body portion at two different levels, a table lock segment which, along with the table blade segment, comprises the table of the slicer, and an indexing turret mounted for rotation along an axis substantially parallel with that of the blade and therebeneath having a plurality of surfaces, at least two flat surfaces offset at different positions from the axis of the indexing turret, and at least one other side having upstanding blade segments with the blades having uniform spacing therealong, whereby, upon indexing the turret in combination with positioning the table blade segment at two different levels, four different thicknesses of flat slices may be made, and cuts such as french fries may be made.

2. In the food slicer of claim 1, a second set of upstanding blade segments on uniform spacing but different than the spacing of the first set of upstanding blade segments, whereby, upon indexing the turret, two different cuts such as french fries and shoe strings may be made.

3. In the food slicer of claim 1, one of said flat surfaces of the turret being angled upwardly toward the blade, whereby the offset from the axis of the turret of the flat faces is the same where the turret engages the table locking segment.

4. In the food slicer of claim 1, indexing turret lock means on the table lock segment comprising, an offset portion at the lead edge of the table lock segment, a notch in the indexing turret corresponding to the table lock offset, and for engagement with the same by sliding the table lock segment in and out of the guides provided therefor in the sides of the table, whereby the indexing turret is indexed by means of releasing the same by moving the table lock segment rearwardly, and after indexing, moving the same forwardly to thereby lockingly engage the working surface of the indexing turret.

5. In the food slicer of claim 1, said indexing turret being rotatably mounted at one end, and loosely mounted for rotation at the other end with a four position positive lock therein, a yieldably positioned knob provides for the rotational indexing of the indexing turret.

6. In the food slicer of claim 1, parallel ways in the sides of the body for positioning the table blade segment at two different levels, latch means provided in the side having a member extending into engagement with a lock detent in one side of the table blade support, and a table lock latch for removably securing the table lock segment in sliding relationship to the sides of the body.

7. In combination with the food slicer of claim 1, a pusher having a pusher grip portion for grasping by the hand, a pusher body having a finger shield and finger grip portion therein, a plurality of pins extending from beneath said pusher, said pusher body portion having a width to overlap the sides of the body of the slicer, whereby the pusher, through the medium of the pins on its lower portion, engages the foodstuff to be slided, and in addition the base portion, upon overlapping the sides of the slicer, determines a position in spaced relationship to the cutting blades where the pins will not extend into contact therewith and thus minimize the amount of salvage of the foodstuff not sliced.

8. In combination with the food slicer of claim 1, a deflector provided beneath the blade of the table lock segment and in cooperative angled relationship therewith for directing the foodstuffs downwardly.

9. In combination with the food slicer of claim 1, said base having a counter stop at the rear portion thereof, whereby the base may be positioned on a table or counter adjacent the edge thereof, and the counter stop portion engages the same to provide an anchor for the same against the reactive forces when the foodstuffs are shoved into the blade.

10. In the food slicer of claim 1, said base body portion having a plate recess substantially beneath the blade in a curvilinear configuration, whereby a blade may be positioned beneath the blade to receive the sliced foodstuffs as the same are cut.

11. A food slicer with indexing turret comprising, in combination, a base supporting a body portion, a blade angled across the body portion and between the sides thereof, a table blade segment insertable into the body portion at two different parallel levels, a table lock segment which, along with the table blade segment, comprises the table of the slicer, and an indexing turret having four faces positioned along an axis substantially parallel with that of the blade and therebeneath characterized by a pair of opposed flat surfaces offset at different positions from the axis of the indexing turret, and a pair of upstanding blade segments on opposed faces with the blades having uniform spacing on each such face, whereby, upon indexing the turret in combination with positioning the table blade segment at two different levels, four different thicknesses of flat slices may be made, and two different widths of string slices such as french fries and shoe string potatoes may be cut.

12. In the food slicer of claim 11, indexing turret lock means on the table lock segment comprising, an offset portion at the lead edge of the table lock segment, a notch in the indexing turret corresponding to the table lock offset, and for engagement with the same by sliding the table lock segment in and out of the guides provided therefor in the sides of the table, whereby the indexing turret is indexed by means of releasing the same by moving the table lock segment rearwardly, and after indexing, moving the same forwardly to thereby lockingly engage the working surface of the indexing turret.

13. In the food slicer of claim 11, said indexing turret being rotatably mounted at one end, and loosely mounted for rotation at the other end with a four position positive lock therein, a yieldably positioned knob provides for the rotational indexing of the indexing turret.

14. In the food slicer of claim 11, parallel ways in the sides of the body for positioning the table blade segment at two different levels, latch means provided in the side having a member extending into engagement with a lock detent in one side of the table blade support, and a table lock latch for removably securing the table lock segment in sliding relationship to the sides of the body.

15. In combination with the food slicer of claim 11, a pusher having a pusher grip portion for grasping by the hand, a pusher body having a finger shield and finger grip portion therein, and a plurality of pins extending from beneath said pusher, said pusher body portion having a width to overlap the sides of the body of the slicer, whereby the pusher, through the medium of the pins on its lower portion, engage the foodstuff to be sliced and in addition the base portion, upon overlapping the sides of the slicer, determine a position in spaced relationship to the cutting blades where the pins will not extend into contact therewith, and thus minimize the amount of salvage of the foodstuff not sliced.

16. In combination with the food slicer of claim 11, a deflector provided beneath the blade of the table lock segment and in cooperative angled relationship therewith for directing the foodstuffs downwardly.

17. In combination with the food slicer of claim 11, said base having a counter stop at the rear portion thereof, whereby the base may be positioned on a table or counter adjacent the edge thereof, and the counter stop portion engages the same to provide an anchor for the same against the reactive forces when the foodstuffs are shoved into the blade.

18. In the food slicer of claim 11, said base body portion having a plate recess substantially beneath the blade in a curvilinear configuration, whereby a blade may be positioned beneath the blade to receive the sliced foodstuffs as the same are cut.

19. In the food slicer of claim 12, said indexing turret being rotatably mounted at one end, and loosely mounted for rotation at the other end with a four position positive lock therein, a yieldably positioned knob provides for the rotational indexing of the indexing turret.

20. In combination with the food slicer of claim 19, a pusher having a pusher grip portion for grasping by the hand, a pusher body having a finger shield and finger grip portion therein, and a plurality of pins extending from beneath said pusher, said pusher body portion having a width to overlap the sides of the body of the slicer, whereby the pusher, through the medium of the pins on its lower portion, engage the foodstuff to be sliced and in addition the base portion, upon overlapping the sides of the slicer, determine a position in spaced relationship to the cutting blades where the pins will not extend into contact therewith, and thus minimize the amount of salvage of the foodstuff not sliced.

21. A food slicer with indexing turret comprising, in combination, a body having a base portion and opposed sides, a blade angled across the body portion and between the sides thereof, a table blade segment insertable into the body portion, a table lock segment which, along with the table blade segment, comprises the table of the slicer, an indexing turret mounted for rotation along an axis substantially parallel with that of the blade and therebeneath having a plurality of surfaces, means yieldably urging said table lock segment toward the indexing turret, and a plurality of cams at one end of the turret adjacent each turret surface, such cams being proportioned to engage the table lock segment and retract the same while the indexing turret is rotated to place its various surfaces in operative relationship with the blade, whereby, upon indexing the turret, the different surfaces on the indexing turret may be positioned in operative relationship with the blade.

22. In the food slicer of claim 21, a plurality of spaced french fry blades on one of the surfaces of the indexing turret.

23. In the food slicer of claim 22, a second set of upstanding blade segments on uniform spacing but narrower than the french fry blades on another turret surface and in opposed relationship to the first set of blades, whereby slices of different thicknesses and widths may be made by indexing the turret.

24. In the food slicer of claim 21, one of said surfaces being angled upwardly toward the blade, whereby the offset from the axis of the turret of the angled surface differs from other surfaces.

25. In the food slicer of claim 21, parallel ways in the sides of the body for positioning the table blade segment at different levels, and latch means provided in one side having a member extending into said parallel ways and into engagement with a lock detent in one side of the table blade support, whereby the blade is positioned at different spaced relationship with the turret surfaces.

26. In the food slicer of claim 21, a pusher having a pusher grip portion for grasping by the hand, a pusher body having a finger shield and finger grip portion therein, a plurality of pins extending from beneath said pusher, said pusher body portion having a width to overlap the sides of the body of the slicer, whereby the pusher, through the medium of the pins on its lower portion, engages the foodstuff to be sliced, and in addition the base portion, upon overlapping the sides of the slicer, determines a position in spaced relationship to the cutting blades where the pins will not extend into contact therewith and thus minimize the amount of salvage of the foodstuff not sliced.

27. In the food slicer of claim 21, a deflector provided beneath the blade of the table lock segment and in cooperative angled relationship therewith for directing the foodstuffs downwardly.

28. In the food slicer of claim 21, said base having a counter stop at the rear portion thereof, whereby the base may be positioned on a table or counter adjacent the edge thereof, and the counter stop portion engages the same to provide an anchor for the same against the reactive forces when the foodstuffs are shoved into the blade.

29. In the food slicer of claim 21, said base body portion having a plate recess substantially beneath the blade in a curvilinear configuration, whereby a plate may be positioned beneath the blade to receive the sliced foodstuffs as the same are cut.

30. In the food slicer of claim 21, said base portion having a base foot with a plurality of bowl stops positioned thereon, whereby a bowl having a ring base may be positioned atop the foot and secured against dislodgement by means of the bowl stops.

* * * * *